US005534402A

United States Patent [19]

Kuno et al.

[11] Patent Number: 5,534,402

[45] Date of Patent: Jul. 9, 1996

[54] DIRECT POSITIVE SILVER HALIDE PHOTOGRAPHIC MATERIAL

[75] Inventors: Koichi Kuno; Hiroyuki Mifune, both of Kanagawa, Japan

[73] Assignee: Fuji Photo Film Co., Ltd., Kanagawa, Japan

[21] Appl. No.: 355,024

[22] Filed: Dec. 13, 1994

[30] Foreign Application Priority Data

Dec. 13, 1993 [JP] Japan ..... 5-311955

[51] Int. Cl.[6] ..... G03C 1/485

[52] U.S. Cl. ..... 430/596; 430/589; 430/597; 430/603; 430/604; 430/606

[58] Field of Search ..... 430/597, 606, 430/589, 596, 603, 604

[56] References Cited

U.S. PATENT DOCUMENTS 4,820,625 4/1989 Saeki et al. ..... 430/597

5,273,874 12/1993 Kojima et al. ..... 430/603

5,314,799 5/1994 Takagi ..... 430/596

OTHER PUBLICATIONS

Science et Industries Photographiques A Journal Published with the Support of the Nationale de la Recherche Scientifique, Feb. 1957.

*Primary Examiner*—Thorl Chea

*Attorney, Agent, or Firm*—Sughrue, Mion, Zinn, Macpeak & Seas

[57] ABSTRACT

A direct-positive silver halide photographic material is disclosed, which comprises a support having thereon at least one prefogged light-sensitive silver halide emulsion layer, wherein said silver halide emulsion is an emulsion which has been previously fogged with a gold compound and a tellurium compound.

8 Claims, No Drawings

DIRECT POSITIVE SILVER HALIDE PHOTOGRAPHIC MATERIAL

FIELD OF THE INVENTION

The present invention relates to a photographic material containing a prefogged direct-positive silver halide emulsion and, more particularly, to a direct positive silver halide photographic material having an improved storage stability.

BACKGROUND OF THE INVENTION

Direct-positive silver halide photographic materials are used for copy of various kinds of photographs. In most cases, they are used for printing positive copies from positive original images or negative copies from negative original images. Such direct-positive photographic materials have been previously obtained by using a prefogged direct-positive silver halide photographic emulsion. In order to fog emulsions, there can be used various known methods including an optical, chemical or another treatment. Especially good results can be achieved, e.g., by using the methods described in *Scientifique et Industrie Photographie,* 28, January, 57–65 (1957). More specifically, silver halide grains are fogged with highly intense light, or by reductive fogging with thiourea dioxide, stannous chloride or the like, or using a gold or another noble metal compound. Also, the combination of a reducer with a gold compound or a compound of a metal which is more electrically positive than silver (e.g., a rhodium compound, a platinum compound or an iridium compound) can be used for fogging silver halide grains.

However, the direct-positive silver halide photographic materials obtained by such the methods as described above frequently cause large changes in sensitivity, $D_{max}$ and $D_{min}$ upon long-term storage, particularly under the condition of high temperature and high humidity. Accordingly, further improvement is required thereof.

SUMMARY OF THE INVENTION

A first object of the present invention is to provide a direct-positive silver halide photographic material having a sufficient reversal performance.

A second object of the present invention is to provide a direct-positive silver halide photographic material which causes slight change in photographic characteristics upon storage for a long time.

The above-described objects are attained with a direct-positive silver halide photographic material comprising a support having thereon at least one prefogged light-sensitive silver halide emulsion layer, wherein the silver halide emulsion is an emulsion which has been previously fogged with a gold compound and a tellurium compound.

DETAILED DESCRIPTION OF THE INVENTION

The present invention is concretely described below in detail.

The tellurium compounds which can be used in the present invention are compounds capable of producing silver telluride on the surfaces of silver halide emulsion grains. Suitable examples of such the compounds include the tellurium compounds as disclosed in JP-A-04-204640 (the term "JP-A" as used herein means an "unexamined published Japanese patent application"), JP-A-04-271341, JP-A-04-333043, JP-A-5-303157, JP-A-6-27573, JP-A-6-175258, JP-A-6-180478, Japanese Patent Application Nos. 5-4203, 5-4204, 5-106977 and 5-286916, and so on.

Among these tellurium compounds, particularly preferred compounds are those represented by formulas (V), (VI) and (VII):

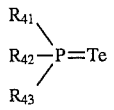

(III)

wherein $R_{41}$, $R_{42}$, and $R_{43}$ each represents an aliphatic group, an aromatic group, a heterocyclic group, —$OR_{44}$, —$NR_{45}(R_{46})$, —$SR_{47}$, —$SiR_{48}(R_{49})(R_{20})$, X or a hydrogen atom; $R_{44}$ and $R_{47}$ each represents an aliphatic group, an aromatic group, a heterocyclic group, a hydrogen atom, or a cation; $R_{45}$ and $R_{46}$ each represents an aliphatic group, an aromatic group, a heterocyclic group, or a hydrogen atom; $R_{48}$, $R_{49}$, and $R_{20}$ each represents an aliphatic group; and X represents a halogen atom.

Formula (V) is described in detail below.

In formula (V), the aliphatic group represented by $R_{41}$, $R_{42}$, $R_{43}$, $R_{44}$, $R_{45}$, $R_{46}$, $R_{47}$, $R_{48}$, $R_{49}$, and $R_{20}$ is preferably an aliphatic group having from 1 to 30 carbon atoms, and particularly preferably a straight chain, branched or cyclic alkyl group having from 1 to 20 carbon atoms, an alkenyl group, an alkinyl group, or an aralkyl group. Examples of the alkyl group, the alkenyl group, the alkinyl group, and the aralkyl group include, for example, methyl, ethyl, n-propyl, isopropyl, t-butyl, n-octyl, n-decyl, n-hexadecyl, cyclopentyl, cyclohexyl, allyl, butenyl, 3-pentenyl, propargyl, 3-pentyl, benzyl, and phenetyl.

In formula (V), the aromatic group represented by $R_{41}$, $R_{42}$, $R_{43}$, $R_{44}$, $R_{45}$, $R_{46}$, and $R_{47}$ is preferably an aromatic group having from 6 to 30 carbon atoms, and particularly preferably a monocyclic or a condensed aryl group having from 6 to 20 carbon atoms, such as phenyl, naphthyl, etc.

In formula (V), the heterocyclic group represented by $R_{41}$, $R_{42}$, $R_{43}$, $R_{44}$, $R_{45}$, $R_{46}$, and $R_{47}$ is preferably a 3- to 10-membered saturated or unsaturated heterocyclic group containing at least one of a nitrogen atom, an oxygen atom, and a sulfur atom. The heterocyclic group may be a monocyclic ring or may form a condensed ring with an aromatic ring or a heterocyclic ring. Particularly preferred heterocyclic groups include 5-membered or 6-membered aromatic heterocyclic groups such as pyridyl, furyl, thienyl, thiazolyl, imidazolyl, benzimidazolyl, etc.

In formula (V), the cation represented by $R_{44}$ and $R_{47}$ is, for example, an alkali metal ion or an ammonium ion.

In formula (V), the halogen atom represented by X is, for example, fluorine, chlorine, bromine, or iodine.

Furthermore, the foregoing aliphatic group, aromatic group, and heterocyclic group each may be substituted with a substituent such as, an alkyl group, an aralkyl group, an alkenyl group, an alkinyl group, an aryl group, an alkoxy group, an aryloxy group, an amino group, an acylamino group, a ureido group, a urethane group, a sulfonylamino group, a sulfamoyl group, a carbamoyl group, a sulfonyl group, a sulfinyl group, an alkyloxycarbonyl group, an aryloxycarbonyl group, an acyl group, an acyloxy group, a phosphoric acid amido group, a diacylamino group, an imido group, an alkylthio group, an arylthio group, a halogen atom, a cyano group, a sulfo group, a carboxy group, a hydroxy group, a phosphono group, a nitro group, or a heterocyclic group. These groups may be further substituted. When two or more substituents are present, they may be the same or different.

In formula (V), $R_{41}$, $R_{42}$, and $R_{43}$ may bond together to form a ring with a phosphorus atom. Further, $R_{45}$ and $R_{46}$ may bond with each other to form a nitrogen-containing heterocyclic ring.

In formula (V), $R_{41}$, $R_{42}$, and $R_{43}$ each preferably represents an aliphatic group or an aromatic group, and more preferably represents an alkyl group or an aromatic group.

Formula (VI) is shown below:

$$R_{21}-\overset{\overset{\displaystyle Te}{\|}}{C}-R_{22} \qquad \text{(IV)}$$

wherein $R_{21}$ represents an aliphatic group, an aromatic group, a heterocyclic group, or —$NR_{23}(R_{24})$; $R_{22}$ represents —$NR_{25}(R_{26})$, —$N(R_{27})N(R_{28})R_{29}$, or —$OR_{30}$, wherein $R_{23}$, $R_{24}$, $R_{25}$, $R_{26}$, $R_{27}$, $R_{28}$, $R_{29}$ and $R_{30}$ each represents a hydrogen atom, an aliphatic group, an aromatic group, a heterocyclic group or an acyl group, and wherein $R_{21}$ and $R_{25}$, $R_{21}$ and $R_{27}$, $R_{21}$ and $R_{28}$, $R_{21}$ and $R_{30}$, $R_{23}$ and $R_{25}$, $R_{23}$ and $R_{27}$, $R_{23}$ and $R_{28}$, or $R_{23}$ and $R_{30}$ may bond with each other to form ring.

Formula (VI) is described in detail below.

In formula (VI), the aliphatic group, aromatic group and heterocyclic group represented by $R_{21}$, $R_{23}$, $R_{24}$, $R_{25}$, $R_{26}$, $R_{27}$, $R_{28}$, $R_{29}$ and $R_{30}$ have the same meaning as those in formula (V), respectively.

In formula (VI), the acyl group represented by $R_{23}$, $R_{24}$, $R_{25}$, $R_{26}$, $R_{27}$, $R_{28}$, $R_{29}$ and $R_{30}$ is preferably an acyl group having from 1 to 30 carbon atoms, and particularly preferably a straight chain or branched acyl group having from 1 to 20 carbon atoms, such as, acetyl, benzoyl, formyl, pivaloyl, or decanoyl.

When $R_{21}$ and $R_{25}$, $R_{21}$ and $R_{27}$, $R_{21}$ and $R_{28}$, $R_{21}$ and $R_{30}$, $R_{23}$ and $R_{25}$, $R_{23}$ and $R_{27}$, $R_{23}$ and $R_{28}$, or $R_{23}$ and $R_{30}$ bond with each other to form a ring, suitable groups for $R_{21}$, $R_{23}$, $R_{25}$, $R_{27}$, $R_{28}$ and $R_{30}$ include an alkylene group, an arylene group, an aralkylene group, and an alkenylene group.

Also, the foregoing aliphatic group, aromatic group, and heterocyclic group each may be substituted with one or more substituents as described above in regard to formula (V).

In formula (VI), $R_{21}$ preferably represents an aliphatic group, an aromatic group, or —$NR_{23}(R_{24})$; and $R_{22}$ preferably represents —$NR_{25}(R_{26})$, wherein $R_{23}$, $R_{24}$, $R_{25}$ and $R_{26}$ each represents an aliphatic group or an aromatic group.

In formula (VI), $R_{21}$ particularly preferably represents an aromatic group or —$NR_{23}(R_{24})$; and $R_{22}$ particularly preferably represents —$NR_{25}(R_{26})$, wherein $R_{23}$, $R_{24}$, $R_{25}$, and $R_{26}$ each represents an alkyl group or an aromatic group. In this case, it is particularly preferred that $R_{21}$ and $R_{25}$, and $R_{23}$ and $R_{25}$, form a ring together with an alkylene group, an arylene group, an aralkylene group, or an alkenylene group.

$$R_{31}-(Te)_n-R_{32} \qquad \text{(VII)}$$

In formula (VII), $R_{31}$ and $R_{32}$ are the same or different, and each represents an aliphatic group, an aromatic group, a heterocyclic group or —(C=Y')—$R_{33}$; and n represents 1 or 2. Herein, $R_{33}$ represents a hydrogen atom, an aliphatic group, an aromatic group, a heterocyclic group, —$NR_{34}(R_{35})$, —$OR_{36}$ or —$SR_{37}$, and Y' represents an oxygen atom, a sulfur atom or —$N(R_{38})$—; wherein $R_{34}$, $R_{35}$, $R_{36}$, $R_{37}$ and $R_{38}$ each represents a hydrogen atom, an aliphatic group, an aromatic group or a heterocyclic group.

Formula (VII) is described below in detail.

The aliphatic, aromatic and heterocyclic groups included in the groups represented by any of $R_{31}$, $R_{32}$, $R_{33}$, $R_{34}$, $R_{35}$, $R_{36}$, $R_{37}$ and $R_{38}$ have the same meaning as those in formula (V) respectively.

Also, the foregoing aliphatic, aromatic and heterocyclic groups in formula (VII) may be substituted with the same substituents as described in formula (V).

Therein, $R_{31}$ and $R_{32}$, and $R_{34}$ and $R_{35}$ may bond with each other to form a ring.

In formula (VII), $R_{31}$ and $R_{32}$ are preferably a heterocyclic group or —(C=Y')—$R_{33}$. Herein, $R_{33}$ represents —$NR_{34}(R_{35})$ or —$OR_{36}$, Y' represents an oxygen atom, and $R_{34}$, $R_{35}$ and $R_{36}$ each represents an aliphatic, aromatic or heterocyclic group.

In formula (VII), $R_{31}$ and $R_{32}$ are more preferably —(C=Y')—$R_{33}$. Herein, $R_{33}$ represents —$NR_{34}(R_{35})$, Y' represents an oxygen atom, and $R_{34}$ and $R_{35}$ each represents an aliphatic, aromatic or heterocyclic group.

Specific examples of the compounds represented by formulas (V), (VI) and (VII) respectively are illustrated below. However, the invention should not be construed as being limited to these examples.

$(nC_4H_9)_3P=Te$ 1.

$(tC_4H_9)_3P=Te$ 2.

3.

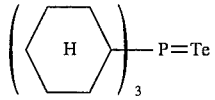

$((i)C_3H_7)_3P=Te$ 4.

5.

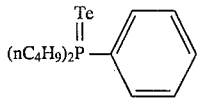

6.

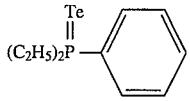

$((i)C_4H_9)_3P=Te$ 7.

$((i)C_4H_9)_2PC_4H_9(n)$ 8.

$(i)C_3H_7P(C_4H_9(n))_2$ 9.

$((i)C_3H_7)_2PC_4H_9(n)$ 10.

$(i)C_3H_7P(C_4H_9(i))_2$ 11.

$((i)C_3H_7)_2PC_4H_9(i)$ 12.

$((i)C_3H_7)_2PC_8H_{17}(n)$ 13.

$C_2H_5P(OC_2H_5)_2$ 14.

$(nC_4H_9O)_3P=Te$ 15.

$C_2H_5P(N(CH_3)_2)_2$ 16.

17.

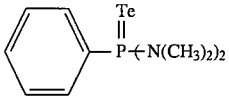

-continued
18. $((CH_3)_2N)_3P{=}Te$
19. $((CH_3)_3SiO)_2\overset{Te}{\overset{\|}{P}}H$
20. 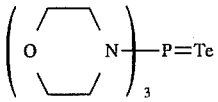
21. $(C_2H_5)_2\overset{Te}{\overset{\|}{P}}N(C_2H_5)_2$
22. 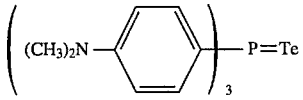
23. 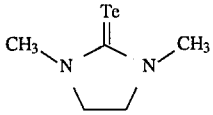
24. 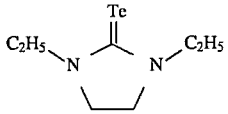
25. 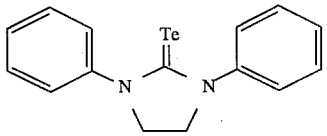
26. 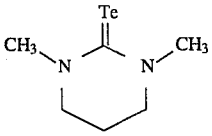
27. 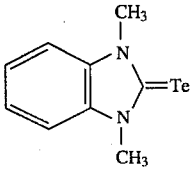
28. 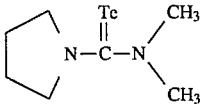
29. 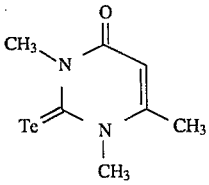
30. 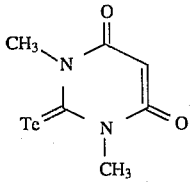
-continued
31. 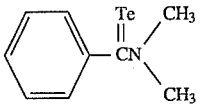
32. 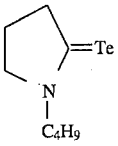
33. 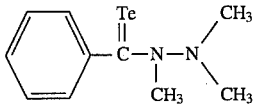
34. 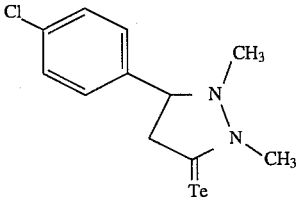
35. 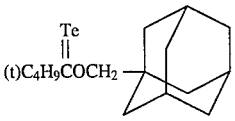
36. 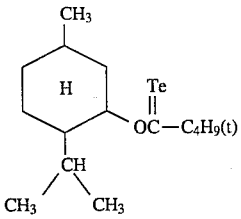
37. 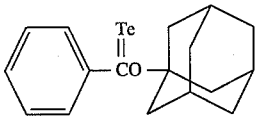
38. 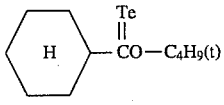
39. $Te{-}\overset{O}{\overset{\|}{C}}N(C_6H_5)CH_3)_2$
40. $Te{-}\overset{O}{\overset{\|}{C}}N(C_2H_5)_2)_2$
41. $Te{-}\overset{O}{\overset{\|}{C}}N(C_6H_5)iC_3H_7)_2$
42. $Te{-}\overset{O}{\overset{\|}{C}}N(iC_3H_7)_2)_2$
43. 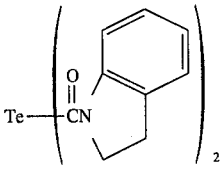

-continued
44.
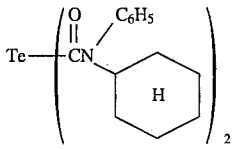
45.
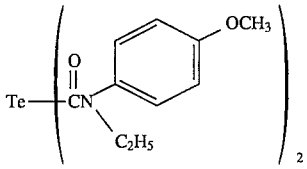
46.
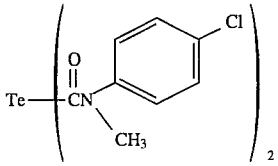
47.
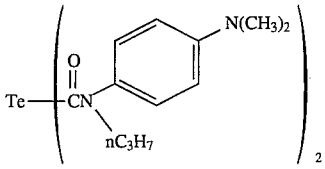
48.
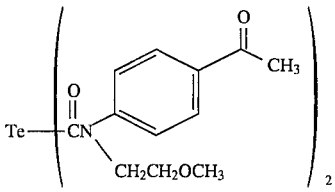
49.
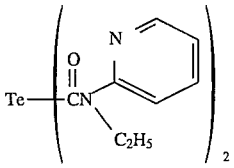
50.
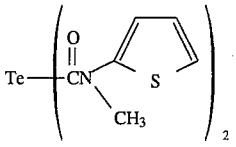
51.
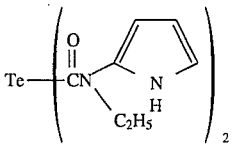
52.
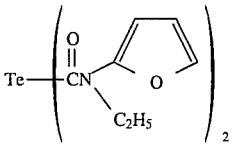
-continued
53.
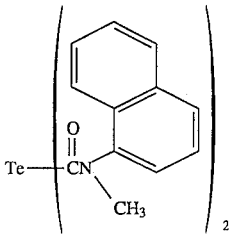
54.
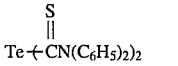
55.
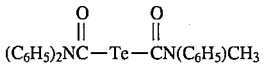
56.
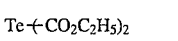
57.
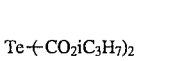
58.
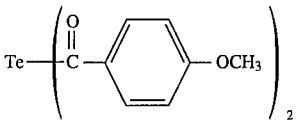
59.
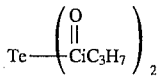
60.
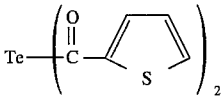
61.
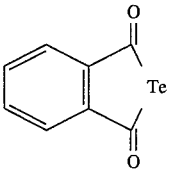
62.
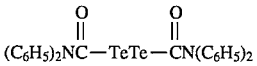
63.
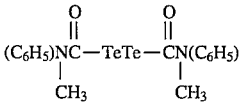
64.
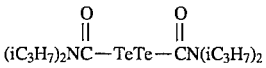
65.
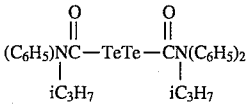
66.
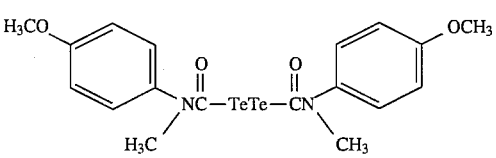
67.
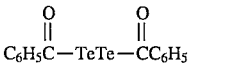

-continued

68.

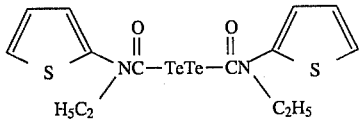

69.

$Te{+}CN(C_6H_5)_2)_2$

70.

$Te{+}C{-}N(C_6H_5)(CH_2C_6H_5))_2$

Among these, Compounds 10, 15, 23, 39, 62 and 70 are particularly preferred.

The tellurium sensitizers used in the present invention are compounds of the kind which can produce silver telluride, which is presumed to function as fog nucleus, on the surface of silver halide emulsion grains.

The production rate of silver telluride in a silver halide emulsion can be examined by the method described below.

When a tellurium sensitizer is added to a silver halide emulsion in a large amount (e.g., $1\times10^{-3}$ mole/mole Ag), the silver telluride produced shows its absorption in the visible region. Therefore, the method proposed for sulfur sensitizers by E. Moisar in *Journal of Photographic Science,* vol. 14, p. 181 (1966) and ibid., vol. 16, p. 102 (1968) can be applied to tellurium sensitizers. Specifically, that method consists in determining the quantity of silver sulfide produced in a silver halide emulsion by using the formula of Kubelka-Munk in which the concentration of silver sulfide in the emulsion is correlated with the infinite reflectivity of the emulsion in the visible region (at the wavelength of 520 nm), and so the relative production rate of silver telluride can be easily determined using the same method as the above. Further, since the foregoing reaction is seemingly comparable to the first-order reaction, the pseudo first-order reaction rate constant thereof can be determined. For instance, a silver bromide emulsion having the crystal form of an octahedron and an average grain size of 0.5 μm (in which 0.75 mole of AgBr and 80 g of gelatin are contained per Kg of emulsion) is thermostated at 50° C. as the pH and the pAg thereof are maintained at 6.3 and 8.3, respectively, and thereto is added a tellurium compound dissolved in an organic solvent (e.g., methanol) in an amount of $1\times10^{-1}$ mole/mole-Ag. The emulsion is placed in a cell having a thickness of 1 cm, and its reflectivity (R) at the wavelength of 520 nm was measured at regular intervals with a spectrophotometer equipped with an integrating sphere by reference to a blank emulsion. The pseudo first-order reaction rate constant k ($min^{-1}$) can be evaluated by substituting the successively measured reflectivities in the Kubelka-Munk formula $(1-R^2)/2R$ and examining changes in value of that formula. Since R is constantly one (R=1) unless silver telluride is not produced, the value of the Kubelka-Munk formula is kept at 0, which is the same as in the case of tellurium compound-free emulsions. As for the tellurium compounds used as a sensitizer, it is preferable in the present invention that they have a first-order reaction rate constant k of from $1\times10^{-8}$ to $1\times10^{0}$ $min^{-1}$, measured under the same condition as the testing method described above.

When a tellurium sensitizer is added in such a reduced amount as to make it difficult to detect the absorption of silver telluride in the visible region, on the other hand, the silver telluride produced can be determined by separating it from the unreacted tellurium sensitizer. For instance, silver telluride is separated out by soaking the emulsion in an aqueous halide solution or an aqueous solution of a water-soluble mercapto compound, and then undergoes the quantitative analysis for a trace amount of tellurium according to the atomic absorption method or the like. The reaction rate in this case varies greatly in the range of several orders of magnitude depending upon not only the type of the tellurium compound used but also the halide composition, the temperature, the pAg and the pH of an emulsion as the subject. The tellurium sensitizers used preferably in the present invention are those capable of producing silver telluride when they are added to a concrete silver halide emulsion having intended halide composition and crystal habit. In the present invention, generally such the tellurium compounds capable of producing silver telluride can be advantageously used when they are added to a silver bromide emulsion which is under a temperature ranging from 40° C. to 95° C. or has its pH in the range of 3 to 10 or its pAg in the range of 6 to 11. Within this scope, the tellurium compounds which have their pseudo first-order reaction rate constant k in the range of $1\times10^{-7}$ to $1\times10^{-1}$ $min^{-1}$, determined by the foregoing testing method are more preferred as tellurium sensitizers.

The present tellurium compounds represented by formulae (V), (VI) and (VII) can be synthesized according to conventional methods.

More specifically, they can be synthesized by the methods described in *J. Chem. Soc. (A)*, 2927 (1969); *J. Organomet. Chem.,* 4, 320 (1965); ibid., 1, 200 (1963); ibid., 113 C35 (1976); *Phosphorus Sulfur,* 15, 155 (1983); *Chem. Ber.,* 109, 2996 (1976); *J. Chem. Soc. Chem. Commun.,* 635 (1980); ibid., 1102 (1979); ibid., 645 (1979); ibid., 820 (1987); *J. Chem. Soc. Perkin. Trans.,* 1, 2191 (1980); *The Chemistry of Organo Selenium and Tellurium Compounds* edited by S. Patai, vol. 1 (1986) and vol. 2, (1987); *Tetrahedron Letters,* 31, 3587 (1990); *J. Chem. Res., Synopses,* 2, 56 (1990); *Bull. Chem. Soc. Japan,* 62, 2117 (1989); ibid., 60, 771 (1987); *J. Organometallic Chem.,* 338, 9 (1988); ibid., 306 C36 (1986); *Nippon Kagakukai Shi,* vol. 7, 1475 (1987); *Zeitschrift Chemie,* 26, 179 (1986); *Chemistry Letters,* 3, 475 (1987); *Indian Journal of Chemistry, Section A,* 25A, 57 (1986); *Angewandte Chemie,* 97, 1051 (1985); *Spectrochimica Acta, Part A,* 38A, 185 (1982); *Organic Preparations and Procedures International,* 10, 289 (1978); and *Organometallics,* 1, 470 (1982).

The amounts of selenium and tellurium sensitizers used in the present invention, though they depend on a kind of the silver halide grains used, a condition of chemical ripening and an amount of the gold compound used, are generally from $1\times10^{-8}$ to 1 mole, preferably from $1\times10^{-7}$ to $5\times10^{-1}$ mole, per mole of silver halide.

Gold compounds used in the examples of the present invention may be any of gold salts used for fogging photographic silver halide grains, which are disclosed, e.g., in U.S. Pat. Nos. 2,399,083 and 2,642,361. Specific examples thereof include potassium chloroaurate, aurithiocyanate, potassium chloroaurate, auric trichloride, aurosulfobenzothiazole methochloride.

The amount of a gold compound used in the present invention can be varied in a wide range. In general, however, it is preferred that the gold compound be added in an amount of from $1\times10^{-8}$ to $1\times10^{-1}$ mole per mole of the silver halide. Among the above gold compounds, potassium chloroaurate is particularly preferably used as a gold sensitizer.

It is preferable that silver halide grains be firstly reacted with a tellurium compound and then admixed with a gold compound as a gold sensitizer. However, those compounds can be added in the reverse order, or the tellurium compound can be used simultaneously with the gold sensitizer. In the present invention, the silver halide grains may be fogged before they are coated, or they may be fogged after they are coated. The condition under which silver halide grains are fogged can be varied variously. In general, the fogging treatment can be effected in the pH of about 4 to about 9, preferably 5 to 8, in the pAg of about 5 to about 11, preferably 6 to 10, and at a temperature of from about 40° C. to about 100° C., preferably from about 50° C. to about 70° C.

Emulsions used for the present direct-positive silver halide photographic material are classified into two groups. Emulsions belonging to one of two groups are those comprising silver halide grains which contain inside the grains a nucleus capable of trapping free electrons and are previously fogged at the surfaces thereof. As the free-electron trapping nucleus contained in the emulsions of the above-described type, there can be used at least one salt of rhodium, ruthenium, osmium, rhenium or iridium.

Emulsions belonging to the other group are those which don't provide any free-electron trapping nuclei to the inside of the silver halide grains and are chemically fogged at the surface of silver halide grains. These emulsions themselves cannot provide any direct-positive images. However, it becomes possible for them to provide direct-positive images when they are used in combination with an organic desensitizing dye or an organic desensitizer. Additionally, organic desensitizing dyes and organic desensitizers can be also used in the aforementioned silver halide emulsions which contain a free-electron trapping nucleus inside the grains.

As the emulsion containing electron trapping nucleus, there can be used the emulsions disclosed, e.g., in JP-B-43-4125 (the term "JP-B" as used herein means an "examined Japanese patent publication"), JP-B-43-29405, U.S. Pat. Nos. 2,401,051, 2,976,149 and 3,023,102, British Patents 707,704 and 1,097,999, French Patents 1,520,824 and 1,520,817, and Belgian Patents 713,272, 721,567 and 681,768.

As the emulsion of the type which does not contain any electron trapping nuclei, there can be used the emulsions disclosed, e.g., in British Patents 1,186,717, 1,186,714 and 1,186,716 and U.S. Pat. Nos. 3,501,306, 3,501,307, 3,501,310, 3,531,288 and 1,520,817.

The silver halide used in the present invention may have any composition, including silver chloride, silver chlorobromide, silver iodochlorobromide, silver bromide, silver iodobromide and so on. When silver chlorobromide or silver iodochlorobromide is used, it is desirable that the chloride content therein be not less than 50 mole %, more preferably not less than 70 mole %. When silver iodochlorobromide or silver iodobromide is used, it is desirable that the iodide content therein be not more than 5 mole %, more preferably at most 3 mole %.

The grain size is preferably from 0.10 μm to 1.0 μm, more preferably from 0.15 μm to 0.40 μm.

It is preferable for the silver halide grains in the photographic emulsion to have a regular crystal form, such as a cubic or octahedral form.

As the grain size distribution, a narrow distribution is preferred. In particular, the so-called monodispersed emulsion in which at least 90%, desirably at least 95%, by number of the whole grains have their individual sizes within the range of an average grain size of ±40%.

The inside electron-trapping nucleus used in the present invention can be introduced by incorporating a salt compound of rhodium, ruthenium, osmium, rhenium or iridium into silver halide grains in an amount of generally $1\times10^{-7}$ to $1\times10^{-3}$ mole, preferably $1\times10^{-6}$ to $1\times10^{-4}$ mole, per mole of the silver halide.

As the complex salt of such transition metals as cited above, a hexadentate ligand complex salt represented by the following formula are preferably used:

$$[M(NY)_nL_{(6-n)}]^m$$

wherein M is rhodium, ruthenium, osmium, rhenium or iridium; L is a crosslinking ligand; Y is oxygen or sulfur; m is 0, −1, −2 or −3; and n is 0, 1 or 2.

Suitable examples of a crosslinking ligand for L, other than nitrosyl and thionitrosyl, include a halide ligand (fluoride, chloride, bromide and iodide), a cyanide ligand, a cyanate ligand, a thiocyanate ligand, a selenocyanate ligand, a tellurocyanate ligand, an azide ligand and an aquo ligand. As the aquo ligand, it is desirable that one or two of the ligands represented by L be an aquo ligand.

Specific examples of transition metal complex salts which can be used in the present invention are illustrated below.

1. $[RhCl_6]^{-3}$
2. $[RuCl_6]^{-3}$
3. $[ReCl_6]^{-3}$
4. $[RuBr_6]^{-3}$
5. $[OsCl_6]^{-3}$
6. $[Ru(NO)Cl_5]^{-2}$
7. $[Ru(NO)_2Cl_4]^{-1}$
8. $[Ru(NO)(H_2O)Cl_4]^{-1}$
9. $[Rh(NO)Cl_5]^{-2}$
10. $[Re(NO)Cl_5]^{-2}$
11. $[Re(NO)CN_5]^{-2}$
12. $[Re(NO)ClCN_4]^{-2}$
13. $[Rh(NO)_2Cl_4]^{-1}$
14. $[Rh(NO)(H_2O)Cl_4]^{-1}$
15. $[Ru(NO)CN_5]^{-2}$
16. $[Ru(NO)Br_5]^{-2}$
17. $[Rh(NS)Cl_5]^{-2}$
18. $[Os(NO)Cl_5]^{-2}$
19. $[Re(NO)Cl_5]^{-1}$
20. $[Os(NS)Cl_4(TeCN)]^{-2}$
21. $[Ru(NS)Cl_5]^{-2}$
22. $[Ru(NS)Cl_4(SeCN)]^{-2}$
23. $[Os(NS)Cl(SCN)_4]^{-2}$
24. $[Ir(NO)Cl_5]^{-2}$

Among these, transition metal complex salts 1 and 6 are particularly preferred.

Such a metal complex as cited above can be incorporated in silver halide by adding during the formation of silver halide grains.

As the good time for the addition, although the foregoing metal complexes may be added so as to be uniformly distributed throughout the individual silver halide grains, it is preferable for them to be added so that they may be present in the core part of individual silver halide grains.

Examples of an organic desensitizing dye which can be preferably used in the present invention include cyanine dyes, merocyanine dyes and quinoxaline dyes. As the cyanine dyes, those represented by formulae (I), (II) and (III) respectively can be preferably used:

(I)

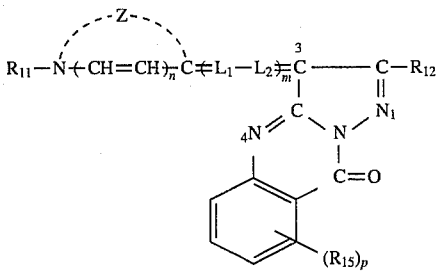

(II)

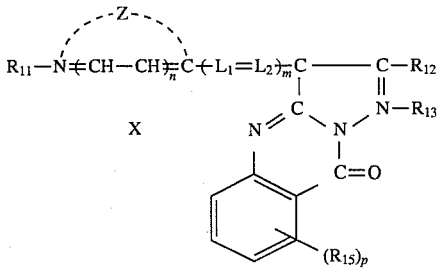

(III)

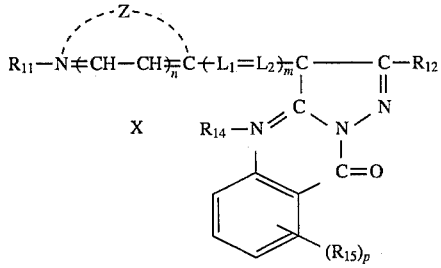

In the formulae (I), (II) and (III), $R_{11}$ and $R_{13}$ each represent an unsubstituted alkyl group such as methyl, ethyl, propyl, isopropyl, n-butyl, n-pentyl, n-hexyl, etc.; or a substituted alkyl group including a hydroxyalkyl group such as β-hydroxyethyl, γ-hydroxypropyl, etc., an acetoxyalkyl group such as β-acetoxyethyl, γ-acetoxypropyl, etc., an alkoxyalkyl group such as β-methoxyethyl, γ-methoxypropyl, etc., a carboxyalkyl group such as β-carboxyethyl, γ-carboxypropyl, δ-carboxybutyl, ω-carboxypentyl, etc., an alkoxycarbonylalkyl group such as β-methoxycarbonylethyl, γ-ethoxycarbonylpropyl, etc., a sulfoalkyl group such as β-sulfoethyl, γ-sulfopropyl, γ-sulfobutyl, δ-sulfobutyl, etc., an aralkyl group such as benzyl, phenetyl, etc., a sulfoaralkyl group such as p-sulfophenetyl, etc., a carboxyaralkyl group such as p-carboxyphenetyl, etc., a vinylmethyl group, and so on. $R_{12}$ represents a hydrogen atom or a substituent known as a pyrazolo[5,1-b]quinazolone compound such as an alkyl group (e.g., methyl, ethyl, propyl, benzyl), an alkoxyl group (e.g., methoxyl, ethoxyl), a carboxyl group, an alkoxycarbonyl group (e.g., methoxycarbonyl, ethoxycarbonyl), a hydroxyl group, an aryl group (e.g., phenyl, p-methoxyphenyl) and so on; $R_{14}$ represents a hydrogen atom, an alkyl group (e.g., methyl, ethyl, propyl), a cycloalkyl group (e.g., cyclohexyl) or an aryl group (e.g., phenyl); $L_1$ and $L_2$ each represent an unsubstituted or substituted methine group, for example, —CH= or —$CR_{16}$= (wherein $R_{16}$ represents an alkyl group such as methyl, ethyl, ethoxyethyl, etc., or an aryl group such as phenyl, etc.), and further $L_1$ and $R_{11}$ may bond each other via a methine chain; Z represents atoms necessary for forming a cyanine heterocyclic nucleus (e.g., oxazoline ring, oxazole ring, benzoxazole nucleus, naphthoxazole nucleus, thiazoline nucleus, thiazole nucleus, benzothiazole nucleus, naphthothiazole nucleus, selenazole nucleus, benzoselenazole nucleus, naphthoselenazole nucleus, 2-pyridine nucleus, 4-pyridine nucleus, 2-quinoline nucleus, 4-quinoline nucleus, 1-isoquinoline nucleus, 3-isoquinoline nucleus, imidazole nucleus, benzimidazole nucleus, indolenine nucleus, imidazo(4,5-b)quinoxaline nucleus and pyrrolidine nucleus wherein they may contain a substituent in a benzene nucleus of a hetero ring and/or a hereto ring condensed); $R_{15}$ represents a substituent known as a pyrazolo[5,1-b]quinazolone compound, such as a halogen atom (e.g., fluorine, chlorine, bromine), a lower alkyl group (e.g., methyl, ethyl), an alkoxyl group (e.g., methoxyl, ethoxyl), an aryl group (e.g., phenyl), a carboxyl group, an alkoxycarbonyl group (e.g., methoxycarbonyl), an acylamino group (e.g., acetylamino), an amino group, a nitro group, a phenoxy group, an alkylamino group, a sulfonic acid group, etc.; n is 0 or 1; m is 1; and p is 1, 2, 3 or 4. In particular, the compounds represented by formulae (II) and (III) wherein $R_{12}$ is an alkyl or aryl group and $R_{14}$ is an alkyl group are preferred over the others. $X^{\ominus}$ represents an acid anion, such as a chloride ion, a bromide ion, an iodide ion, a thiocyanate ion, a perchlorate ion, a p-toluenesulfonate ion, a methylsulfate ion, an ethylsulfate ion, etc.

Specific examples of compounds represented by formulae (I), (II) and (III) respectively are illustrated below. However, the compounds usable in the present invention should not be construed as being limited to these examples.

I-(1)

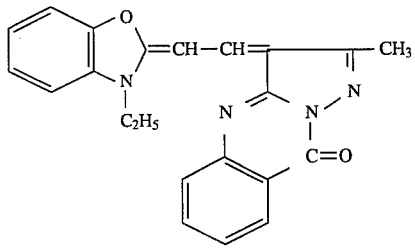

I-(2)

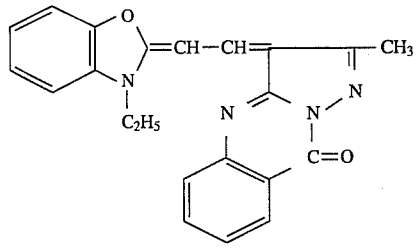

I-(3)

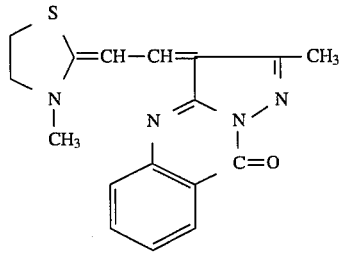

I-(4)

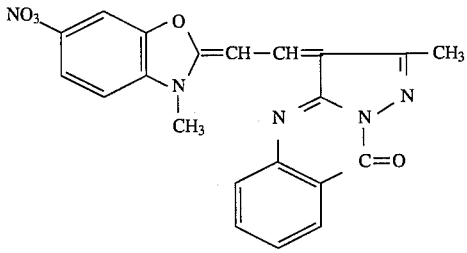

-continued
I-(5)
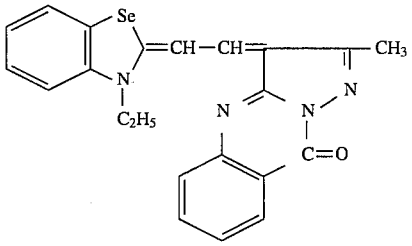
I-(6)
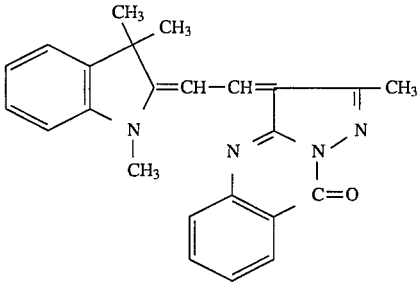
I-(7)
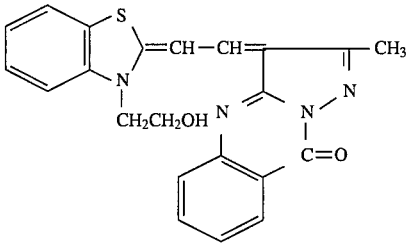
I-(8)
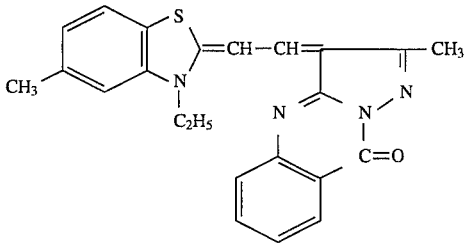
I-(9)
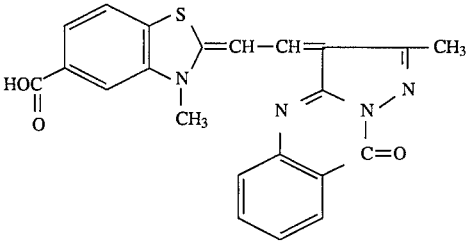
II-(1)
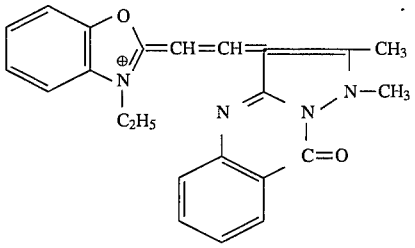
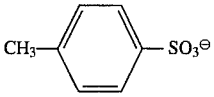
-continued
II-(2)
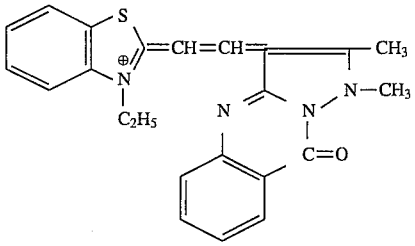
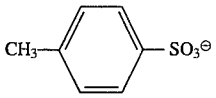
II-(3)
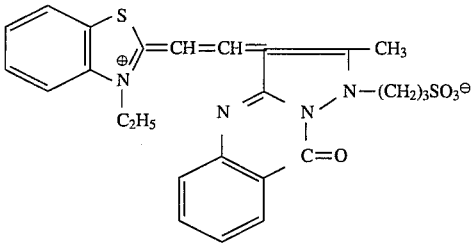
II-(4)
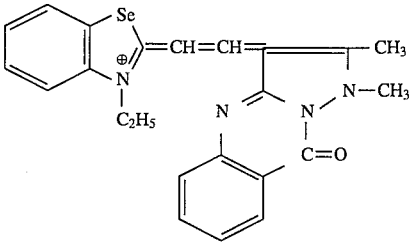
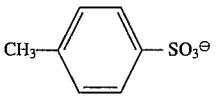
II-(5)
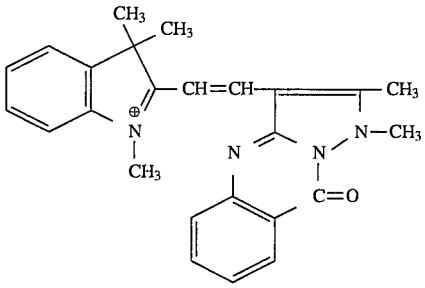
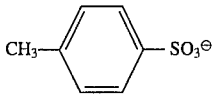

-continued

II-(6)

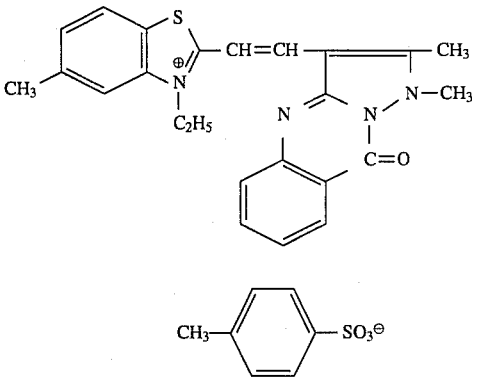

II-(7)

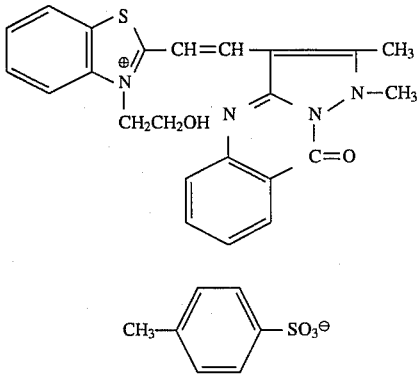

III-(1)

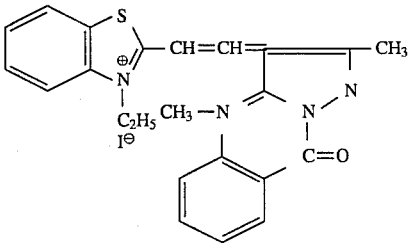

III-(2)

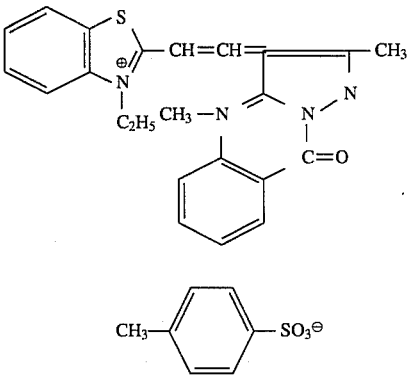

-continued

III-(3)

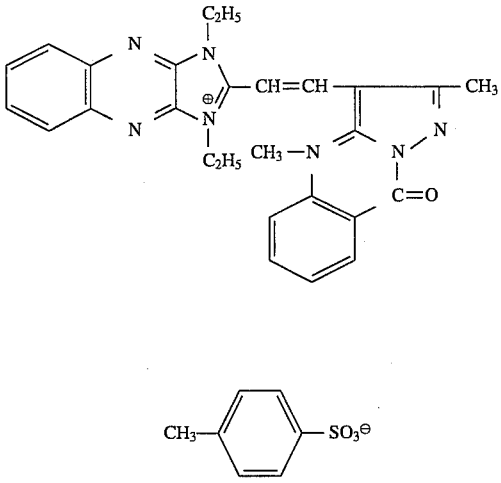

III-(4)

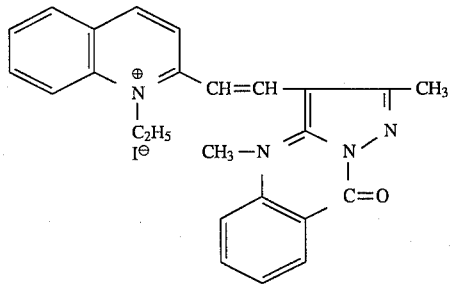

III-(5)

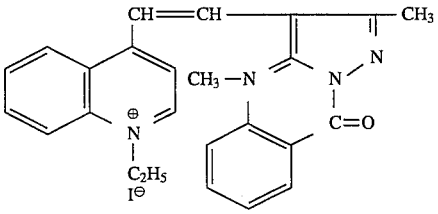

III-(6)

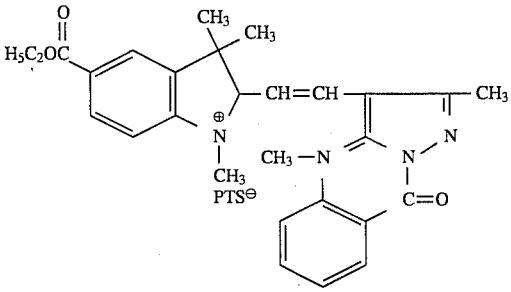

Among these, Compounds III-(2) and III-(6) are particularly preferred.

These compounds are desirably added to a silver halide emulsion in an amount of from 5 mg to 2 g per mole of silver.

As the organic desensitizers which can be used in the present invention, although they may be any of the compounds known as desensitizers, the compounds represented by formula (IV) are preferably used:

(IV)

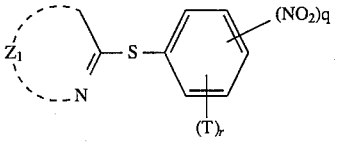

In the formula (IV), $Z_1$ represents nonmetal atomic group necessary for forming a nitrogen-containing heterocyclic ring. T represents an alkyl group, a cycloalkyl group, an alkenyl group, a halogen atom, a cyano group, a trifluoromethyl group, an alkoxy group, an aryloxy group, a hydroxy group, an alkoxycarbonyl group, a carboxyl group, a carbamoyl group, a sulfamoyl group, an aryl group, an acylamino group, a sulfonamido group, a sulfo group or a benzo-condensed ring. The groups described above may further have substituent(s). q represents 1, 2 or 3, and r represents 0, 1 or 2. Specific examples of a nitrogen-containing heterocyclic ring completed by $Z_1$ include a 1,2,4-triazole ring, a 1,3,4 -oxadiazole ring, a 1,3,4-thiadiazole ring, a tetraazaindene ring, a pentaazaindene ring, a triazaindene ring, a benzothiazole ring, a benzimidazole ring, a benzoxazole ring, a pyrimidine ring. a triazine ring, a pyridine ring, a quinoline ring, a quinazoline ring, a phthalazine ring, a quinoxaline ring, an imidazo[4,5-e]quinoxaline ring, a tetrazole ring, a 1,3-diazaazulene ring, and so on. These rings each may further have substituent(s), and may further be condensed together with another ring.

Specific examples of the compound represented by formula (IV) are illustrated below. However, the compounds usable in the present invention should not be construed as being limited to these examples.

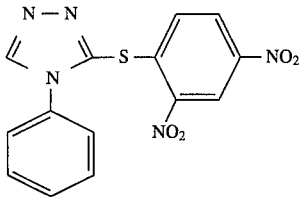
(IV-1)

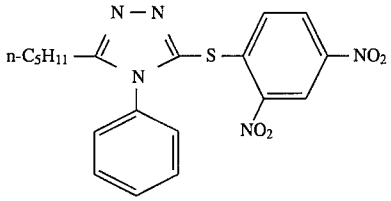
(IV-2)

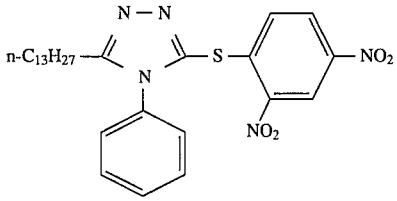
(IV-3)

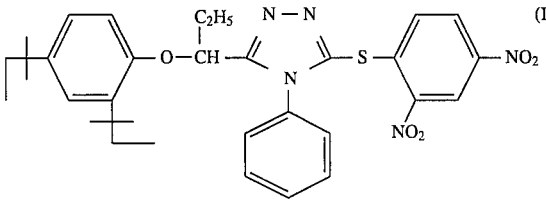
(IV-4)

-continued

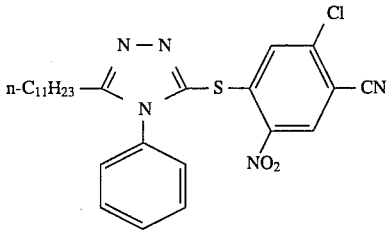
(IV-5)

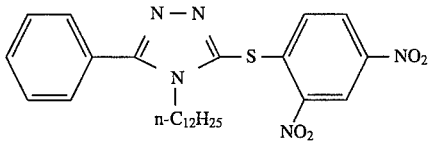
(IV-6)

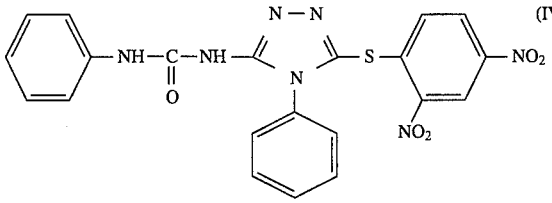
(IV-7)

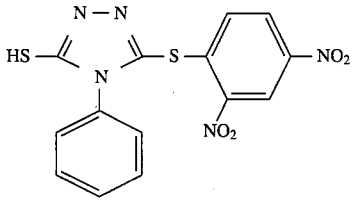
(IV-8)

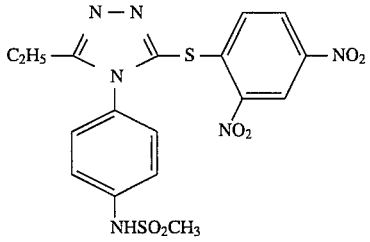
(IV-9)

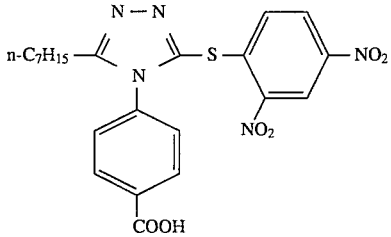
(IV-10)

-continued
(IV-11)
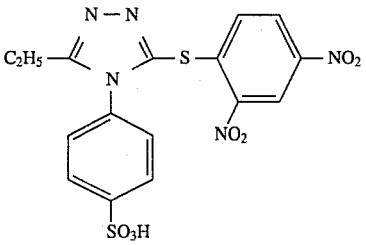
(IV-12)
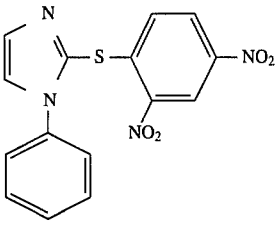
(IV-13)
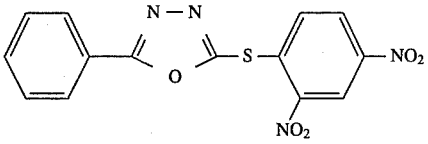
(IV-14)
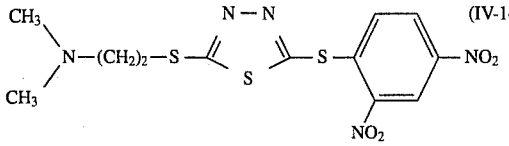
(IV-15)
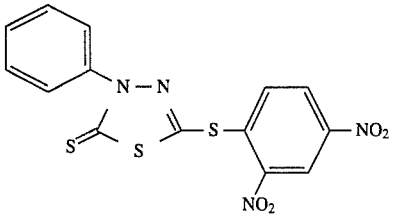
(IV-16)
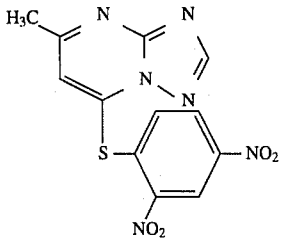
(IV-17)
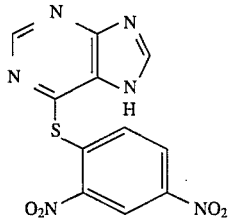
(IV-18)
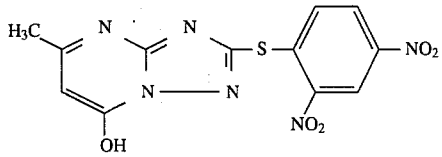
-continued
(IV-19)
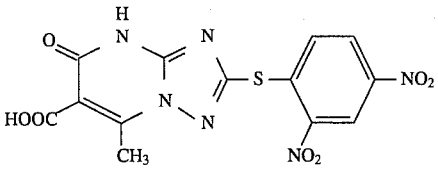
(IV-20)
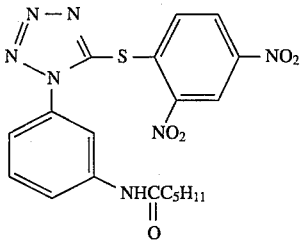
(IV-21)
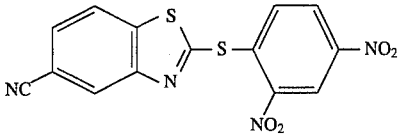
(IV-22)
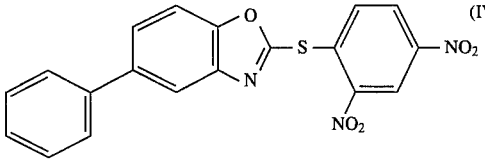
(IV-23)
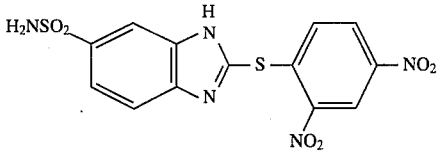
(IV-24)
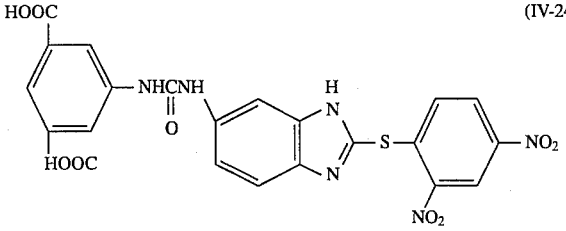
(IV-25)
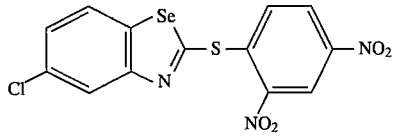
(IV-26)
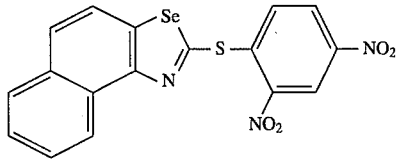
(IV-27)
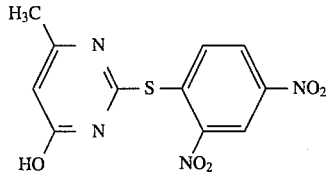

-continued

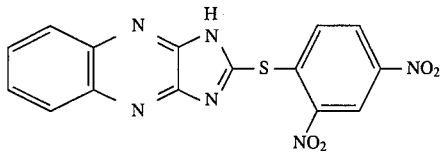

(IV-28)

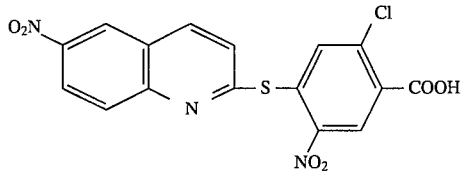

(IV-29)

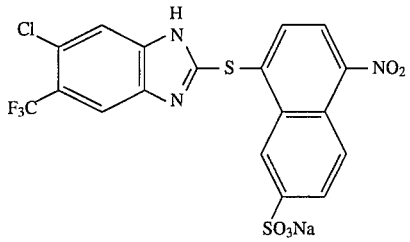

(IV-30)

Among these, Compounds (IV-6) and (IV-23) are particularly preferred.

Synthesis examples of an compound represented by formula (IV) are described in JP-A-41-84639.

It is desirable that the compound represented by formula (IV) be used in an amount of from $1\times10^{-6}$ to $5\times10^{-1}$ mole, particularly from $1\times10^{-5}$ to $2\times10^{-2}$ mole, per mole of the silver halide.

The compound represented by formula (IV) may be incorporated in a photographic material by adding it to a silver halide emulsion solution or a hydrophilic colloid solution in the form of aqueous solution thereof when it is soluble in water, or in the form of its solution in a water-miscible organic solvent such as alcohols (e.g., methanol, ethanol), esters (e.g., ethyl acetate), ketones (e.g., acetone) when it is insoluble in water. In the case where the compound is added to a silver halide emulsion solution, the addition time may be any stage of the preparation of the emulsion as far as it is within the period from the beginning of chemical ripening to just prior to the coating operation. However, it is preferable for the compound of formula (IV) to be added after the completion of chemical ripening, particularly to a coating solution prepared for the coating.

For the purposes of preventing irradiation and halation, and bring about safelight immunity and other improvements, dyes dispersed in a solid condition and/or water-soluble dyes can be added to a direct-positive silver halide photographic material according to the present invention in such an amount that the effect of the present invention is not damaged.

Oxonol dyes, hemioxonol dyes, merocyanine dyes, cyanine dyes and azo dyes can be used without particular limitation with regard to their chemical structures.

Concretely, examples of the dyes which can be used in the present invention include pyrazolone dyes described in JP-B-58-12576 (the term "JP-B" as used herein means an "examined Japanese patent publication"); pyrazolone oxonol dyes described in U.S. Pat. No. 2,274,782; diarylazo dyes described in U.S. Pat. No. 2,956,879; styryl dyes and butadienyl dyes described in U.S. Pat. Nos. 3,423,207 and 3,384,487; merocyanine dyes described in U.S. Pat. No. 2,527,583; merocyanine dyes and oxonol dyes described in U.S. Pat. Nos. 3,486,897, 3,652,284 and 3,718,472; enaminohemioxonol dyes described in U.S. Pat. No. 3,976,661; and dyes described in British Patents 584,609 and 1,177,429, JP-A-48-85130, JP-A- 49-99620, JP-A-49-114420, U.S. Pat. Nos. 2,533,472, 3,148,187, 3,177,078, 3,247,127, 3,540,887, 3,575,704 and 3,653,905.

The dyes which can be used in the present invention can be easily synthesized by the methods described in WO(PCT) 88/04794, European Patents (EP) 0274723A1, 276,566 and 299,435, JP-A-52-92716, JP-A-55-155350, JP-A-55-155351, JP-A- 61-205934, JP-A-48-68623, JP-A-2-282244, U.S. Pat. Nos. 2,527,483, 3,486,897, 3,746,539, 3,933,798, 4,130,429 and 4,040,841, European Patent Application Nos. 385461A and 430186A.

The direct-positive silver halide photographic material according to the present invention can contain various photographic additives used conventionally, other than those described above. Specifically, the photographic material of the present invention may contain as a stabilizer, e.g., triazoles, azaindenes, quaternary benzothiazolium compounds, mercapto compounds, or water-soluble inorganic salts such as salts of cadmium, cobalt, nickel, manganese, gold, thallium, zinc, etc. Also, the photographic material may contain as a hardener, e.g., aldehydes such as formaldehyde, glyoxal, mucochloric acid, etc., s-triazines, epoxides, aziridines, vinylsulfonic acid, and as a coating aid, e.g., saponin, sodium polyalkylene-sulfonate, lauryl or oleyl monoether of polyethylene glycol, amylated alkyltaurines, fluorine-containing compounds, or so on. Further, the photographic material of the present invention can contain color couplers. In addition, the photographic material may contain, if needed, a brightening agent, an ultraviolet absorbent, an antiseptic, a matting agent, an antistatic agent and so on.

The photographic emulsion layers and other hydrophilic colloid layers of the photographic material of the present invention may contain various surfactants to aid coating or to improve antistatic properties, to improve a sliding property and emulsifying dispersion, to prevent adhesion or to improve photographic characteristics (e.g., development acceleration, high contrast, sensitization), etc.

Examples of these surfactants include nonionic surfactants such as saponin (steroid), alkylene oxide derivatives (e.g., polyethylene glycol, polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicone), glycidols (e.g., alkenylsuccinic acid polyglycerides, alkylphenol polyglycerides), fatty acid esters of polyhydric alcohols and alkyl esters of sugar; anionic surfactants having an acid group such as a carboxyl group, a sulfo group, a phospho group, a sulfuric acid ester group or a phosphoric acid ester group, such as alkylcarboxylates, alkylsulfonates, alkylbenzenesulfonates, alkylnaphthalenesulfonates, alkylsulfonic acid ester, alkylphosphoric acid esters, N-acyl-N-alkyltaurines, sulfosuccinic acid esters, sulfoalkylpolyoxyethylene alkylphenyl ethers and polyoxyethylene alkylphosphoric acid ester; amphoteric surfactants such as amino acids, aminoalkylsulfonic acids, aminoalkylsulfonic acid or aminoalkyl acid esters, alkylbetaines and amine oxides; and cationic surfactants such as alkylamine salts, aliphatic or aromatic quaternary ammonium salts, heterocyclic quaternary ammonium salts such as pyridinium salts and imidazolium salts and aliphatic or heterocyclic phosphonium salts or sulfonium salts.

In the light-sensitive material of the present invention, silica, magnesium oxide and polymethylmethacrylate may be contained as a matting agent in the photographic emulsion layer or the hydrophilic colloid layer to prevent adhesion of the material.

The light sensitive material of the present invention may contain dispersions of water-insoluble or sparingly water soluble synthetic polymers to provide dimensional stability. Examples of these polymers include homopolymers of alkyl (meth)acrylates, alkoxyacryl (meth)acrylates, (meth)acrylamide, vinylester (e.g., vinylacetate) and acrylonitrile, or copolymers of two or more of these monomers and polymers of these monomers.

In the emulsions used in the present invention, gelatin is mainly employed as a protective colloid. In particular, inert gelatin is preferably used. As a substitute for gelatin, photographically inert gelatin derivatives (e.g., phthaloylated gelatin) or water-soluble synthetic polymers such as polyvinyl acrylate, polyvinyl alcohol, polyvinyl pyrrolidone, etc., can be used.

The silver halide emulsion of the present invention is coated on any photographic supports.

Examples of the support include glass and film bases such as cellulose acetate, cellulose acetate butylate and polyester (e.g., ethylene terephthalate).

As the developer used in the present invention, the so-called lith developer having a low sulfite ion concentration as well as a developer containing sulfite ion as preservative in a sufficiently high concentration (particularly not less than 0.15 mole/l) can be employed. Further, the pH of a developer used in the present invention is preferably at least 9.5, more preferably 10.5 to 12.3.

The present invention has no particular restriction as to a developing agent used. For instance, dihydroxybenzenes (e.g., hydroquinone), 3-pyrazolidones (e.g., 1-phenyl-3-pyrazolidone, 4,4-dimethyl-1-phenyl-3-pyrazolidone), aminophenols (e.g., N-methyl-p-aminophenol), erythorbic acid, ascorbic acid can be used as a developing agent individually or in combination of two or thereof.

To the developer of the present invention, there may be added sulfites as preservatives, such as sodium sulfite, potassium sulfite, lithium sulfite, sodium bisulfite, potassium metabisulfite and formaldehyde sodium bisulfite. Such sulfites are used in an amount of 0.01 mole/l or more. However, the addition amount thereof should be minimized so far as it can satisfy the need. This is because the addition thereof in a large amount causes the dissolution of silver halide emulsion grains to generate silver stain, and further it is responsible for raising COD (chemical oxygen demand).

The pH of the developer used for the development-processing of the present invention is preferably from 9.0 to 12.0, and more preferably from 9.5 to 12.0.

Suitable examples of alkali agents used for pH adjustment include sodium hydroxide, potassium hydroxide, sodium carbonate and potassium carbonate.

In the developer of the present invention, the carbonate ion functions as a preservative. When the carbonate ion is used as a preservative, the amount is preferably 0.5 mol/liter or more.

In the developer of the present invention, pH buffers such as the sugars disclosed in JP-A-60-93433 (e.g., saccharose), oximes (e.g., acetoxime), phenols (e.g., 5-sulfosalicylic acid), silicates, sodium tertiary phosphate acid potassium tertiary phosphate can be used. The concentration of the pH buffers is preferably 0.3 mole/l or more. However, it is undesirable to use boron compounds, including boric acid and sodium metaborate, as the pH buffers of the present developer because there is a risk that they react with the compound of the present invention represented by formula (I) to deactivate it.

The developer of the present invention may further contain development restrainers such as potassium bromide, potassium iodide, etc.; organic solvents such as ethylene glycol, diethylene glycol, triethylene glycol, dimethylformamide, methyl cellosolve, hexylene glycol, ethanol, methanol, etc.; antifoggants including indazole compounds such as 5-nitroindazole, etc.; benzimidazole compounds such as sodium 2-mercaptobenzimidazole-5-sulfonate, etc.; and benzotriazole compounds such as 5-methylbenzotriazole, etc.; and the development accelerators described in *Research Disclosure,* Vol. 176, No. 17643, Item XXI (December, 1978). Also, it may contain the amine compounds disclosed in U.S. Pat. Nos. 4,269,929, JP-A-61-267759 and JP-A- 2-208652. Further, it may contain toning agents, surfactants, hardeners and so on, if needed.

Furthermore, the amino compounds, including alkanolamines, disclosed in EP-A-0136582, British Patent 958,678, U.S. Pat. No. 3,232,761 and JP-A-56-106244 can be used in the developer of the present invention for the purposes of accelerating the development and increasing the contrast.

The fixer used in the present invention is an aqueous solution containing a thiosulfate, and the pH thereof is 3.8 or more, preferably from 4.2 to 7.0.

As for the fixing agent, sodium thiosulfate and ammonium thiosulfate are exemplified. In particular, ammonium thiosulfate is preferable from the viewpoint of fixing speed. The amount of the fixing agent can be properly chosen, and it is generally set in the range of about 0.1 to about 6 mole per liter.

The fixer may contain a water-soluble aluminum salt as a hardener. Suitable examples of such an aluminum salt include aluminum chloride, aluminum sulfate and potassium alum.

In the fixer, tartaric acid, citric acid, gluconic acid or derivatives thereof can be used alone or as a mixture of two or more thereof. These acids are effective when added in an amount of 0.005 mole or more, preferably from 0.01 to 0.03 mole, per liter of fixer.

Further, the fixer can optionally contain preservatives (e.g., sulfites, bisulfites), pH buffers (e.g., acetic acid, boric acid), pH adjusters (e.g., sulfuric acid, ammonia), chelating agents having an ability for softening hard water, surfactants, wetting agents, fixation accelerators, and the compounds disclosed in JP-A-62-78551.

As for the fixation accelerators, the thiourea derivatives disclosed in JP-A-45-35754, JP-A-58-122535 and JP-A-58-122536, triple bond-containing alcohols and the thioether compounds disclosed in U.S. Pat. No. 4,126,459 are exemplified. Also, the compounds disclosed in JP-A-2-44355 may be used as fixation accelerators.

Furthermore, the fixer can contain as a dye elution accelerator the compounds disclosed in JP-A-64-4739.

In the photographic processing method of the present invention, the photographic material is processed with washing water or a stabilizing solution after the development and fixing steps, and then dried. It is possible to perform the washing or stabilizing step using washing water or a stabilizing solution at a replenishment rate of not more 3 liter per $m^2$ of silver halide photographic material (including the replenishment rate of zero, namely the washing with stored water). That is, not only saving water in the washing step but also making a piping work unnecessary in setting up an automatic developing machine becomes possible.

As a method for reduction in replenishment of washing water, the multistage (e.g., two-stage or three-stage) counter current process has been known for a long time. If this process is applied to the present invention, the fixation-processed photographic material is processed as it is brought into contact with successive, more and more cleaned processing solutions, that is, processing solutions less and less contaminated with the fixer. Accordingly, more efficient washing can be carried out.

When the washing step is performed with a small amount of water, it is preferable to use a washing tank equipped with squeeze rollers or crossover rollers, as disclosed in JP-A-63-18350 and JP-A-62-287252. Further, the addition of various kinds of oxidizing agents and the filtration may be supplemented for the purpose of reduction in pollution load. An increase in pollution load is a big problem that the washing with little water faces.

In the water-saved or pipeless processing, it is preferable that some means of proofing against molds are applied to the washing water or stabilizing solution.

Examples of means of proofing against molds include the ultraviolet irradiation method described in JP-A-60- 263939, the magnetic field-using method described in JP-A-60-263940, the method of using water purified with an ion exchange resin described in JP-A-61-131632 and the method of using antibacteria disclosed in JP-A-62-115154, JP-A-62-153952, JP-A-62-220951 and JP-A-62-209532.

Further, the foregoing methods can be used in combination with antibacteria, antimolds, surfactants and so on described, e.g., in L. F. West, "Water Quality Criteria", *Photo. Sci. & Eng.,* Vol. 9, No. 6 (1965); M. W. Reach, "Microbiological Growths in Motion Picture Processing", *SMPTE Journal,* Vol. 85 (1976); R. O. Deegan, "Photo Processing Wash Water Biocides", *J. Imaging Tech.,* Vol. 10, No. 6 (1984); JP-A-57-8542, JP-A-57-56143, JP-A-58-105145, JP-A-57-132146, JP-A-58-18631, JP-A-57-97530, and JP-A-57-157244.

Furthermore, the washing or stabilizing bath can contain as microbiocides the isothiazolidine compounds described in R. T. Kreiman, *J. Imaging Tech.,* 10(6), p. 242 (1984); the compounds disclosed in *Research Disclosure,* Vol, 205, No. 20526 (1981, No. 4).

In addition, the bath may contain the compounds as described in Hiroshi Horiguchi, *Bohkin Bohbai no Kagaku* (which means "Antibacterial and Moldproof Chemistry"), Sankyo Shuppan (1982), and *Bohkin Bohbai Gijutsu Handbook* (which means "Handbook of Antibacterial and Moldproof arts), Nippon Bobkin Bohbai Gakkai (1986).

When the washing is carried out with a small amount of water in the present method, it is also preferable that the constitution of the washing process disclosed in JP-A-63-143548 be adopted.

In the present invention also, part or all of the overflow generated from the washing or stabilizing bath by replenishing the bath with the water, which is rendered moldproof by the above-cited means, in proportion as the processing proceeds can be used in the prior step wherein the processing solution having a fixing ability is used, as described in JP-A-60-235133.

In the development processing of the present invention, it is preferable that the development time is from 5 seconds to 3 minutes, more preferably from 8 seconds to 2 minutes, and the development temperature is from 18° C. to 50° C., more preferably from 24° C. to 40° C.

As for the fixation processing, it is preferable that the fixation time is from 5 seconds to 3 minutes at a temperature of from 18° C. to 50° C. More preferably, the fixation time and temperature is from 6 seconds to 2 minutes and from 24° C. to 40° C., respectively. Sufficient fixation can be effected within the above-described temperature and time ranges, and so the sensitizing dyes can be eluted to such an extent as not to generate color stains.

The temperature and time in the washing or stabilizing step are preferably from 5° C. to 50° C. and from 6 seconds to 3 minutes, respectively, and it is more preferable for them to be from 15° C. to 40° C. and from 8 seconds to 2 minutes, respectively.

The developed, fixed and washed (or stabilized) photographic materials are dried after being passed between a pair of squeeze rollers. They are dried at a temperature of from about 40° C. to about 100° C. Though it can be properly varied depending on the surrounding condition, the drying time is generally from about 4 seconds to about 3 minutes. In particular, it is preferable for them to be dried at a temperature of from about 40° C. to about 80° C. for a time of from about 5 seconds to about 1 minute.

In performing the photographic processing on condition that the dry-to-dry time is 100 seconds or less, it is preferable to take the following means for prevention of developer mark (uneven development) characteristic of rapid processing. That is, there are adopted such means that the rubber rollers disclosed in JP-A-63-151943 are employed as rollers fixed on the exit of the developing tank; the speed of jetting the developer components into the developing tank is set at 10 m/min or more in order to vigorously agitate the developer, as disclosed in JP-A-63-151944; and the developer is more vigorously agitated at least during development-processing than under standing-by, as disclosed in JP-A-63-264758. For achieving more rapid processing, it is particularly desirable that rollers installed in a fixing tank be constructed of counter rollers to accelerate the fixation speed. Owing to the counter-roller construction, the rollers can be reduced in number and the fixing tank can be diminished in size. That is, it becomes possible to make an automatic developing machine more compact.

The present invention is concretely explained in greater detail by reference to the following examples. However, the invention should not be construed as being limited to these examples.

EXAMPLE 1

Preparation of Emulsions

[Emulsion A]

To Solution I (shown in Table 1) maintained at 60° C., Solutions II and III (shown in Table 1) were simultaneously added for 1 minute with stirring, and then Solutions IV and V (shown in Table 1) were further added over a period of 53 minutes so that the pAg was controlled to 7.8. The emulsion grain obtained was a monodispersed cubic silver bromide grain having an average grain size of 0.2 μm (variation coefficient: 15%).

The thus prepared emulsion grain was washed with water according to a conventional flocculation method, admixed with gelatin, adjusted to pH 6.5 and pAg 6.5, and then admixed with 30 mg/mole-silver of thiourea dioxide as reduction sensitizer. Thereafter, the resulting emulsion was ripened at 65° C. until the achievement of the maximum performance, thereby causing fog therein.

[Emulsion B]

The formation of grain, the washing, the addition of gelatin and the adjustment of pH and pAg were carried out in the same manner as in Emulsion A. The thus obtained emulsion was admixed with 1.0 mg/mole-silver of thiourea dioxide and 5 mg/mole-silver of chloroauric acid, and then ripened at 65° C. until the achievement of the maximum performance, thereby causing fog therein.

[Emulsions C-1 to C-6]

The formation of gelatin, grain, the washing, the addition of gelatin and the adjustment of pH and pAg were carried out in the same manner as in Emulsion A. The thus obtained emulsion was divided in 6 equal portions, and these portions were admixed with separate tellurium compounds (shown in Table 2) in their respective amounts (also shown in Table 2)

and 2 mg/mole-silver of chloroauric acid, and further ripened at 65° C. until the achievement of the maximum performance, thereby causing fog therein.

Preparation of Emulsion-Coated Samples

To each of Emulsions (A) to (C), there were added 135 mg/mole-silver of Compound (1), 20 mg/g-gelatin of sodium polystyrenesulfonate as a thickener, 120 mg/m$^2$ of 1,3-divinylsulfonyl- 2-propanol as a hardener. The thus obtained coating compositions were each coated at a coverage of 2.7 g/m$^2$, based on silver, to a polyethylene terephthalate support simultaneously with application of the lower and upper protective layers described below, thereby preparing the emulsion-coated Sample Nos. 1 to 8.

[Lower Protective Layer]

| | |
|---|---|
| Gelatin | 1 g/m$^2$ |
| Dye (1) | 200 mg/m$^2$ |
| Dye (2) | 100 mg/m$^2$ |
| Dye (3) | 30 mg/m$^2$ |
| Sodium dodecylbenzenesulfonate | 30 mg/m$^2$ |
| Polyethylacrylate latex (average particle size: 0.05 μm) | 500 mg/m$^2$ |

[Upper Protective Layer]

| | |
|---|---|
| Gelatin | 0.8 g/m$^2$ |
| Polymethylmethacrylate latex (average particle size: 0.9 μm) | 40 mg/m$^2$ |
| Sodium dodecylbenzenesulfonate | 30 mg/m$^2$ |
| Colloidal silica | 100 mg/m$^2$ |
| Compound (2) | 3 mg/m$^2$ |
| Compound (3) | 5 mg/m$^2$ |

Additionally, the polyethylene terephthalate support used herein had the backing layer and the back protective layer which had the following compositions respectively:

[Backing Layer]

| | |
|---|---|
| Gelatin | 170 mg/m$^2$ |
| Sodium dodecylbenzenesulfonate | 32 mg/m$^2$ |
| Sodium dihexyl-α-sulfosuccinate | 35 mg/m$^2$ |
| $SnO_2$/Sb (weight ratio: 9/1, average grain size: 0.25 μm) | 300 mg/m$^2$ |

[Back Protective Layer]

| | |
|---|---|
| Gelatin | 3.8 g/m$^2$ |
| Silicon dioxide matting agent (average grain size: 3.5 μm) | 100 mg/m$^2$ |
| Sodium dihexyl-α-sulfosuccinate | 20 mg/m$^2$ |
| Sodium dodecylbenzenesulfonate | 70 mg/m$^2$ |
| Dye (1) | 80 mg/m$^2$ |
| Dye (4) | 140 mg/m$^2$ |
| Dye (5) | 40 mg/m$^2$ |
| Compound (2) | 10 mg/m$^2$ |
| Ethylacrylate latex (average particle size: 0.05 μm) | 500 mg/m$^2$ |
| 1,3-Divinylsulfonyl-2-propanol | 150 mg/m$^2$ |

TABLE 1

| | |
|---|---|
| [Solution I] | |
| Gelatin | 24 g |
| Potassium bromide | 0.9 g |
| Rhodium chloride | 20 mg |
| Water to make | 800 ml |

TABLE 1-continued

| | |
|---|---|
| [Solution II] | |
| Silver nitrate | 3.1 g |
| Water to make | 12 ml |
| [Solution III] | |
| Potassium bromide | 2.4 g |
| Water to make | 12 ml |
| [Solution IV] | |
| Silver nitrate | 166.9 g |
| Water to make | 610 ml |
| [Solution V] | |
| Potassium bromide | 126 g |
| Water to make | 610 ml |

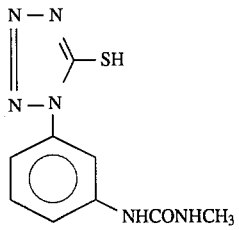

Compound (1)

$C_8F_{17}SO_2N(C_3H_7)CH_2COOK$ Compound (2)

$C_8F_{17}SO_3K$ Compound (3)

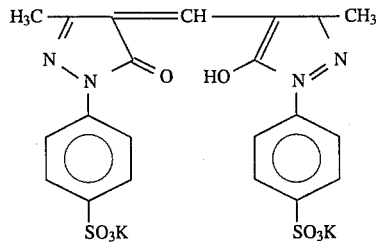

Dye (1)

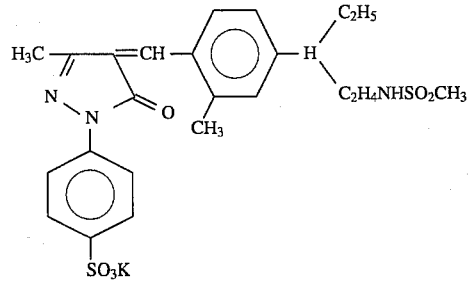

Dye (2)

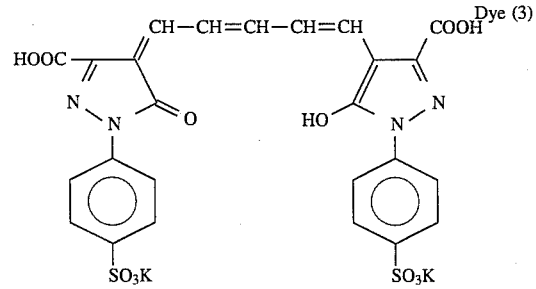

Dye (3)

-continued

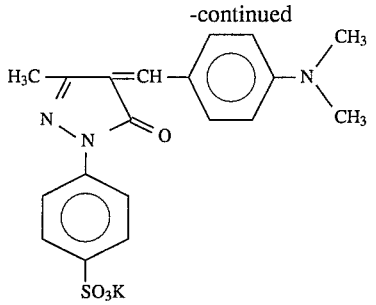

Dye (4)

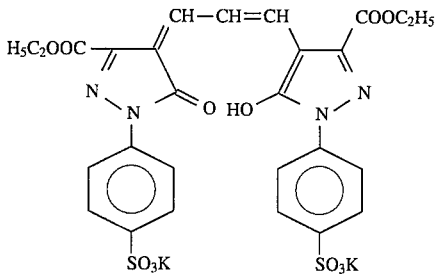

Dye (5)

-continued

| | |
|---|---|
| 5-Methylbenzotriazole | 0.5 g |
| Sodium bromide | 3 g |
| Water to make | 1 l |
| pH adjusted to 11.60 | |

As the sensitivity of the foregoing samples, it is defined as the reciprocal of an exposure amount required for providing the density of 1.5. Each sample was examined for the difference in sensitivity between the 3 days' standing under circumstances of 50° C. and humidity of 80% RH and the storing under natural circumstances. The results obtained are shown in Table 2 as Sensitivity Difference (hot & humid circumstance). Further, each sample was examined for the difference in sensitivity between the 12 months' storing under natural circumstances and the storing in a 5° C. refrigerator. These examination results are also shown in Table 2 as Sensitivity Difference (long lapse).

TABLE 2

| | | Te Compound | | Sensitivity Difference | | |
|---|---|---|---|---|---|---|
| Sample No. | Emulsion | Species | Amount added | hot & humid circumstance | long lapse | note |
| 1 | A | — | — | +0.56 | +0.32 | comparison |
| 2 | B | — | — | +0.34 | +0.26 | comparison |
| 3 | C-1 | (10) | 4.0 | +0.10 | +0.05 | invention |
| 4 | C-2 | (15) | 4.0 | +0.07 | +0.04 | invention |
| 5 | C-3 | (23) | 3.0 | +0.11 | +0.07 | invention |
| 6 | C-4 | (39) | 3.0 | +0.10 | +0.04 | invention |
| 7 | C-5 | (62) | 4.0 | +0.08 | +0.03 | invention |
| 8 | C-6 | (70) | 3.0 | +0.08 | +0.03 | invention |

*by mg/mole-Ag

Evaluation of Photographic Properties

After deairing, the emulsion-coated samples obtained were allowed to stand for 3 days under the circumstances of 50° C. and humidity of 80% RH. Then, the samples were placed under the atmosphere of ordinary temperature and humidity, and exposed to light via a continuous wedge with a printer ("Model P627" made by Dai-Nippon Screen Mfg. Co., Ltd.). Thereafter, they were processed with an automatic developing machine ("Model FG-660F" made by Fuji Photo Film Co., Ltd.), wherein the development was performed for 20 seconds at 38° C. with the developer having the composition set forth below, and the fixation was performed with a fixer ("GR-Fl" produced by Fuji Photo Film Co., Ltd.) and succeeded by washing and drying operations. At the same time, the emulsion-coated samples which had been stored under natural circumstances were also subjected to the foregoing exposure and photographic processing.

[Composition of Developer]

| | |
|---|---|
| Hydroquinone | 35 g |
| N-Methyl-p-aminophenol.½ sulfate | 0.8 g |
| Sodium hydroxide | 9 g |
| Potassium tertiary phosphate | 74 g |
| Potassium sulfite | 90 g |
| Disodium ethylenediaminetetraacetate | 1 g |
| 3-Diethylamino-l-propanol | 15 g |

As is apparent from the results of Table 2, Sample Nos. 3 to 8, according to the present invention have a small change of sensitivity under circumstances of high temperature and humidity or at a long lapse under natural circumstances. That is, the samples according to the present invention have excellent storage stability.

EXAMPLE 2

Preparation of Emulsions

The emulsion grains were prepared in the same manner as in Example 1, except that rhodium chloride was removed from Solution I, and then fogged under the conditions corresponding to those adopted in the fogging of Emulsions A, B and from C-1 to C-6 respectively, thereby preparing Emulsions D, E and from F-1 to F-6 which were free from rhodium chloride as a dope.

Preparation of Emulsion-Coated Samples

The thus prepared emulsions each was coated in the same manner as in Example 1, except that each of those emulsions was admixed with 80 mg/mole-Ag of 4-hydroxy-6-methyl-1,3,3a,7-teteraazaindene in place of Compound (1) and further with Compound III-(6) as a desensitizing dye in the amount of 550 mg per mole of silver, thereby preparing Coated Sample Nos. 9 to 16. The photographic properties of these samples were evaluated by the same method as adopted in Example 1, except that the exposure operation was changed to 1 second's exposure with a tungsten sensitometer (color temperature: 2856° K.). The results obtained are shown in Table 3.

TABLE 3

| Sample No. | Emulsion | Te Compound Species | Te Compound Amount added | Sensitivity Difference hot & humid circumstance | Sensitivity Difference long lapse | note |
|---|---|---|---|---|---|---|
| 9 | D | — | — | +0.67 | +0.48 | comparison |
| 10 | E | — | — | +0.50 | +0.38 | comparison |
| 11 | F-1 | (10) | 4.0 | +0.10 | +0.06 | invention |
| 12 | F-2 | (15) | 4.0 | +0.08 | +0.05 | invention |
| 13 | F-3 | (23) | 3.0 | +0.12 | +0.07 | invention |
| 14 | F-4 | (39) | 3.0 | +0.11 | +0.05 | invention |
| 15 | F-5 | (62) | 4.0 | +0.09 | +0.04 | invention |
| 16 | F-6 | (70) | 3.0 | +0.10 | +0.05 | invention |

*by mg/mole-Ag

As is apparent from the results of Table 3, the effect of the present invention can be produced in not only a prefogged emulsion containing electron-trapping nuclei inside the grains but also an emulsion containing a desensitizing dye to form electron traps at the grain surfaces.

EXAMPLE 3

Preparation of Emulsions

[Emulsion G]

To Solution 1 (shown in Table 4) maintained at 50° C., Solutions 2 and 3 (shown in Table 4) were simultaneously added over a 30-minute period with stirring, thereby forming emulsion grains. The grain obtained was a monodispersed cubic silver chlorobromide grain having an average grain size of 0.24 μm (bromide content: 5 mole %, variation coefficient: 16%). The thus prepared emulsion was washed with water according to a conventional flocculation method, admixed with gelatin, adjusted to pH 7.0 and pAg 6.5, and then admixed with 18 mg/mole-silver of thiourea dioxide as reduction sensitizer. Thereafter, the resulting emulsion was ripened at 65° C. until the achievement of the maximum performance, thereby causing fog therein.

[Emulsion H]

Emulsion H was prepared in the same manner as Emulsion G, except that in fogging the emulsion grains the amount of thiourea dioxide added was changed to 9 mg/mole-silver and 0.7 mg/mole-silver of chloroauric acid was further added.

[Emulsions I-1 to I-6]

Emulsions I-1 to I-6 were prepared in the same manner as Emulsion G, except that in fogging the emulsion grains the tellurium compounds set forth in Table 5 in their respective amounts set forth in Table 5 were used individually in place of thiourea dioxide and 3 mg/mole silver of chloroauric acid was further added to each emulsion.

TABLE 4

| | |
|---|---|
| [Solution 1] | |
| Gelatin | 25 g |
| Sodium chloride | 2.5 g |
| Citric acid | 1.2 g |
| Rhodium chloride | 8 mg |
| Water to make | 1000 ml |
| [Solution 2] | |
| Silver nitrate | 170 g |
| Water to make | 550 ml |
| [Solution 3] | |
| Potassium bromide | 6 g |
| Sodium chloride | 59 g |
| Water to make | 550 ml |

Preparation of Emulsion-Coated Samples

The thus prepared emulsions each was coated in the same manner as in Example 1, except that each of those emulsions was admixed with $5\times10^{-4}$ mole/mole-Ag of Compound IV-6 in place of Compound (1) and further with $1\times10^{-3}$ mole/mole-silver of 5-nitroindazole as an organic desensitizer, and additionally the coverage of each emulsion was changed to 3.2 g/m$^2$, on a silver basis, thereby preparing Coated Sample Nos. 17 to 24. The photographic properties of these samples were evaluated by the same method as adopted in Example 1. The results obtained are shown in Table 5.

TABLE 5

| Sample No. | Emulsion | Te Compound Species | Te Compound Amount added | Sensitivity Difference hot & humid circumstance | Sensitivity Difference long lapse | note |
|---|---|---|---|---|---|---|
| 17 | G | — | — | +0.32 | +0.29 | comparison |
| 18 | H | — | — | +0.15 | +0.10 | comparison |
| 19 | I-1 | (10) | 3.0 | +0.08 | +0.03 | invention |
| 20 | I-2 | (15) | 3.0 | +0.04 | +0.01 | invention |
| 21 | I-3 | (23) | 2.8 | +0.06 | +0.02 | invention |

TABLE 5-continued

| Sample No. | Emulsion | Te Compound Species | Te Compound Amount added | Sensitivity Difference hot & humid circumstance | Sensitivity Difference long lapse | note |
|---|---|---|---|---|---|---|
| 22 | I-4 | (39) | 2.8 | +0.06 | +0.02 | invention |
| 23 | I-5 | (62) | 3.0 | +0.05 | +0.01 | invention |
| 24 | I-6 | (70) | 2.8 | +0.05 | +0.01 | invention |

*by mg/mole-Ag

As is apparent from the results of Table 5, the measures taken by the present invention were also effective for the emulsions having a high chloride content. That is, Sample Nos. 19 to 24 according to the present invention have excellent storage stability.

While the invention has been described in detail and with reference to specific embodiments thereof, it will be apparent to one skilled in the art that various changes and modifications can be made therein without departing from the spirit and scope thereof.

What is claimed is:

1. A direct-positive silver halide photographic material comprising a support having thereon at least one prefogged light-sensitive silver halide emulsion layer, wherein said silver halide emulsion layer contains a silver halide emulsion which has been previously fogged with a gold compound and a tellurium compound.

2. The direct-positive silver halide photographic material as claimed in claim 1, wherein the silver halide emulsion contains at least one transition metal complex salt selected from the group consisting of rhodium compounds, ruthenium compounds, osmium compounds, rhenium compounds and iridium compounds.

3. The direct-positive silver halide photographic material as claimed in claim 1, which further contains at least one compound selected from the group consisting of the dyes represented by formulae (I), (II) and (III) respectively:

(I)

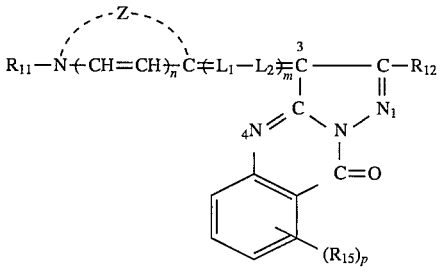

(II)

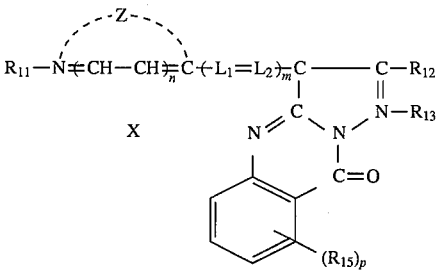

-continued (III)

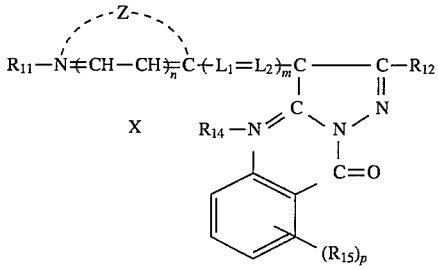

wherein $R_{11}$ and $R_{13}$ each represents an alkyl group; $R_{12}$ represents a hydrogen atom, an alkyl group, an alkoxyl group, a carboxyl group, an alkoxycarbonyl group, a hydroxyl group, or an aryl group; $R_{14}$ represents a hydrogen atom, an alkyl group, a cycloalkyl group, or an aryl group; $L_1$ and $L_2$ each represents a methine group, and $L_1$ and $R_{11}$ may bond with each other via a methine chain; Z represents an atomic group necessary for forming a cyanine heterocyclic nucleus; $R_{15}$ represents a halogen atom, an alkyl group, an alkoxyl group, an aryl group, a carboxyl group, an alkoxycarbonyl group, an acylamino group, an amino group, a nitro group, a phenoxy group, an alkylamino group, or a sulfonic acid group; n is 0 or 1; m is 1; p is 1, 2, 3 or 4; and $X^{\ominus}$ represents an acid anion.

4. The direct-positive silver halide photographic material as claimed in claim 2, which further contains a compound represented by formula (IV):

(IV)

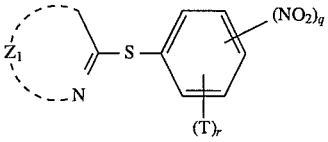

wherein $Z_1$ represents a nonmetal atomic group necessary for forming a nitrogen-containing heterocyclic ring; T represents an alkyl group, a cycloalkyl group, an alkenyl group, a halogen atom, a cyano group, a trifluoromethyl group, an alkoxy group, an aryloxy group, a hydroxy group, an alkoxycarbonyl group, a carboxyl group, a carbamoyl group, a sulfamoyl group, an aryl group, an acylamino group, a sulfonamido group, a sulfo group or a benzo-condensed ring, in which each may further have at least one of a substituent group; q is 1, 2 or 3; and r is 0, 1 or 2.

5. The direct-positive silver halide photographic material as claimed in claim 1, wherein the gold compound is added in an amount of $1\times10^{-8}$ to $1\times10^{-1}$ mole per mole of the silver halide and the tellurium compound is added in an amount of $1\times10^{-8}$ to 1 mole per mole of the silver halide.

6. The direct-positive silver halide photographic material as claimed in claim 2, wherein at least one compound is added in an amount of $1\times10^{-7}$ to $1\times10^{-3}$ mole per mole of silver halide.

7. The direct-positive silver halide photographic material as claimed in claim 3, wherein the dye represented by formulae (I), (II) and (III) is added in an amount of 5 mg to 2 g per mole of silver.

8. The direct-positive silver halide photographic material as claimed in claim 4, wherein the compound represented by formula (IV) is added in an amount of $1\times10^{-6}$ to $5\times10^{-1}$ mole per mole of the silver halide.

* * * * *